US005794823A

United States Patent [19]

Roundtree

[11] Patent Number: 5,794,823

[45] Date of Patent: Aug. 18, 1998

[54] LIMITED ACTION FLOW CONTROL FLUID DISPENSER

[75] Inventor: Stephan Roundtree, Dunstable, Mass.

[73] Assignee: Stainless One Dispensing Systems, Nashua, N.H.

[21] Appl. No.: 690,553

[22] Filed: Jul. 31, 1996

[51] Int. Cl.[6] ..... B65D 83/00

[52] U.S. Cl. ..... 222/400.7; 222/518

[58] Field of Search ..... 222/400.7, 400.8, 222/509, 518; 239/445

[56] References Cited

U.S. PATENT DOCUMENTS

| | | | |
|---|---|---|---|
| 3,096,001 | 7/1963 | Boe et al. | 222/518 |
| 4,281,779 | 8/1981 | Shepard | 222/518 |
| 4,720,076 | 1/1988 | Hyde | 251/122 |
| 4,742,942 | 5/1988 | Dokos et al. | 222/501 |
| 4,760,940 | 8/1988 | Wallace et al. | 222/129.1 |
| 4,982,879 | 1/1991 | Corrado et al. | 222/400.7 |
| 5,368,205 | 11/1994 | Groh | 222/189 |
| 5,385,276 | 1/1995 | Yen-Tang | 222/400.8 |
| 5,607,084 | 3/1997 | George | 222/400.7 |

*Primary Examiner*—Joseph Kaufman
*Attorney, Agent, or Firm*—Vernon C. Maine; Scott J. Asmus

[57] ABSTRACT

A limited action flow control fluid dispenser. The fluid dispenser includes a housing, a plunger positioned within the housing, and a nozzle. The housing has a fluid inlet, a fluid outlet and a cavity. The plunger is longitudinally positioned within the cavity, and is slidable between a first position and a second position. The first position permits fluid flow from the fluid inlet through the cavity and out from the fluid outlet. The second position prevents fluid flow. The plunger includes first and second ends, a substantially uniformly concave section, a velocity reducing section, a sealing section, and a constant volume section. In operation, the plunger serves to reduce foaming in carbonated beverages, such as beer, and facilitate pressurization of the fluid delivery system. In another aspect of the present invention, a velocity reducing device is provided that includes a first end mated with the fluid inlet and a second end that is mated with a fluid supply line. Turbulence is created within the velocity reducing device to reduce the fluid velocity prior to entering the fluid dispenser.

12 Claims, 5 Drawing Sheets

LIMITED ACTION FLOW CONTROL FLUID DISPENSER

BACKGROUND OF THE INVENTION

1. Field of the Invention

The present invention relates to a limited action flow control fluid dispenser for dispensing fluids in a controlled manner and minimizing bacterial contamination in the fluid dispenser and, more specifically, to a limited action flow control fluid dispenser for dispensing carbonated beverages, such as beer, with minimal change in the volume of carbon dioxide in a carbonated beverage, thus reducing foaming when dispensing in a manner that prevents bacterial and enzyme growth in the fluid dispenser and the beverage supply line.

2. Discussion of the Related Art

Traditionally, carbonated beverages, such as beer, are stored in a keg or canister which is attached to a supply line that is, in turn, attached to a faucet or tap. Typically, the entire system is pressurized to keep the beverage fresh and to propel the beverage out of the faucet. A conventional faucet is shown in FIGS. 1 and 2, in which FIG. 1 illustrates the faucet in the closed position when the beverage is not being dispensed, and FIG. 2 illustrates the same faucet in the open position when the beverage is being dispensed. In the closed position, lever 4 is in a first position, and bulb end 6 of valve 5 forms a seal that prevents flow from region 1 (the beverage supply line) to region 2 (the faucet spout). In this closed position, most inner surfaces of faucet body 7 and valve 5 are exposed to the atmosphere. In the open position, lever 4 is in a second position, wherein the seal formed between bulb end 6 and faucet body 7 is released to allow flow around the bulb end from region 1 to region 2 as shown. In the open position, most inner surfaces of faucet body 7 and valve 5, including areas 3 and 8, are exposed to the flowing beverage. Traditionally, the faucet body 7 and the valve 5 are made of either brass or chrome-plated brass due to the relative availability and low cost of these materials.

As noted, faucet parts are typically formed from brass or chrome-plated brass. As is well known to those in the art, however, brass is an alloy that can oxidize in air. As a result of this oxidation, some heavy metals used in brass alloys may leach out as a beverage is dispensed. Alternatively, it is noted that chrome plating used on brass faucets is prone to flaking, thus potentially introducing particulate matter into the beverage, as well as permitting oxidation of the brass substrate to occur in those areas where flaking has occurred.

A further disadvantage of the use of brass or chrome plated brass is that neither of these materials can be properly sterilized for use in the food service industry. Enzymes, which, for example, are naturally present in beer, and airborne bacteria thrive on the cold, dark, and moist exposed surfaces of the faucet and valve when the faucet is closed (FIG. 1). Because traditional beer faucets have large surface areas that are cold, dark, and moist for extended periods, bacterial contamination of the beer when the faucet is opened can be a problem. Prolonged periods of non-use impact the flavor of the beer and can even pose a health risk, leading many users to discard the initial flow of beer before serving. Although this practice lessens the impact of any contamination to the beer's flavor, and may lessen health risks, the discarded beer is wasted, which increases the overall beer cost. Even if conventional faucets were made of materials that could be sterilized, it is noted that many faucets require special tools and extended time periods for disassembly that would make sterilization impractical, particularly in commercial establishments.

Another disadvantage of traditional faucets, as shown in FIGS. 1 and 2, is that the beverage, for example beer, flows through a spout (region 2) that is relatively large and open to the atmosphere. This large volume region allows the dispensed beverage to immediately reach atmospheric pressure when the faucet is opened (FIG. 2), which can lead to excessive foaming. Foaming in beer occurs when the beer is over-pressurized, agitated, heated, or when the beer passes quickly through a region in which there is a sudden decrease in pressure. As shown, when the faucet is opened, the pressurized beer is exposed to a sudden increase in volume, which lowers the beer pressure and produces foam as carbon dioxide, typically dissolved in a beverage such as beer, comes out of solution. As known to those in the art, excess foam is a leading cause of wasted beer. Furthermore, the sudden exposure to a larger volume at atmospheric pressure makes it difficult to establish an appropriate pressure for the beer delivery system. Establishing the appropriate pressure in the beer delivery system is important to prevent over-pressurization that may result in up to 25% of the beer being wasted as foam in the bottom of the container. In addition, because most of the faucet body 7 and the valve 5 are exposed to atmospheric temperatures, typically higher than that of the refrigerated beer, the temperature of the initial flow of beer is warmed by contact, thereby promoting additional foaming.

In addition to excessive foaming and difficulty in establishing system pressure, when a conventional faucet is opened, not only is beer forced past bulb end 6 and into the spout of region 2, but there is also a concomitant intake, or back-draw, of air into the back portion 1 of the faucet. This back-draw can cause air, enzymes, particulate matter, and bacteria to be drawn into the beer supply line connected to the faucet. As a result, contamination can be spread throughout the beer delivery system, creating a deleterious effect on the flavor of the beer, and increasing associated health risks.

In addition to the foregoing, the lever/valve mechanism of the conventional beer faucet typically requires a predetermined force to move from one position to another position, often causing lever 4 to travel through an excessive range of motion of approximately 60°. The predetermined force require to operate the lever/valve mechanism can increase wear, particularly in lever base areas 9 and 10, which may ultimately cause failure and leave the faucet stuck in one position. The required range of motion to operate the mechanism may also be a disadvantage in beer service establishments that have only a limited amount of service space, particularly when lever 4 has an attached decorative handle (not shown).

Improved dispensing taps have been designed to overcome some of the foregoing problems associated with conventional faucets. For example, Hyde, in U.S. Pat. No. 4,720,076, discloses a beer dispensing tap to control flow by minimizing the pressure drop and turbulence when the valve is fully open. The tap maximizes the pressure drop and turbulence in beer flow when the valve is in a nearly closed position, and totally restricts beer flow when the valve is in a fully closed position. The valve is vertically oriented within the tap body, and includes a conically-shaped tip, a radial flange located above the conical tip, and a plug portion located above the radial flange. In the closed position, the radial flange is in light, but intimate, contact with a counter bore in the tap body, and the plug portion of the valve seals against a valve seat to prevent flow. In the fully open position, the plug portion is raised clear of the valve seat and the radial flange is raised clear of the counter bore, allowing full flow through the tap with little or no turbulence. In the nearly closed position, the plug portion of the valve is clear of the valve seat, allowing full delivery pressure through a narrow annular gap formed between the radial flange and the counter bore, thereby maximizing pressure drop and turbulence and producing a creamy flow. The Hyde patent also discloses a dispensing tap nozzle with a length-to-bore ratio such that it retains a column of beer in the nozzle when the tap is in the closed position. This column of beer is retained so that, on slightly re-opening the tap, a creamy flow of beer is obtained.

In operation, the dispensing tap disclosed in the Hyde patent strips carbon dioxide from the beer as it is being dispensed. In particular, when the tap is in the open position, the conically-shaped valve tip causes a convergence in the flow of beer that results in turbulence. This turbulence in the beer flow releases carbon dioxide and promotes foaming. The convergence in the flow of beer is due to the decreasing volume of the conical tip and the gently tapered, but increasing, volume of the bore into which the beer flows. Because the volume into which the beer flows is increasing, and not constant, the tap is difficult to maintain at an appropriate pressure. Furthermore, the flow convergence and the changing volume renders the tap disclosed in the Hyde patent unsuitable for use at high pressures due to excessive foaming.

It is also noted that the Hyde patent discloses the use of a rubber valve to form a diaphragm. However, as is well known in the art, rubber is difficult to sterilize and, due to its porous nature, promotes bacterial growth. Furthermore, although the Hyde patent purports to maximize pressure drop and turbulence in beer flow when the valve is in the nearly closed position, the use of a rubber diaphragm inhibits this function. The pressure on the rubber diaphragm caused by the flow of beer in the nearly closed position can distort the shape of the diaphragm, and move the diaphragm into the closed position. In use, therefore, it would be difficult to maintain the nearly closed position of the valve due to the pressure on the diaphragm.

SUMMARY OF THE INVENTION

Accordingly, the present invention is directed to a fluid dispenser that reduces the possibility for enzyme and bacterial growth within the dispenser and/or fluid supply lines, that does not leach heavy metals or release particulate matter into the flow, and that is capable of sterilization. The present invention is also directed to a fluid dispenser that reduces foaming in carbonated beverages, such as beer, facilitates pressurization of the beverage delivery system, and can operate at high pressure without excessive foaming. The present invention also provides a fluid dispenser with improved ergonomics that requires minimal area for use, and allows maintenance of working components without any specialized tools.

The present invention is directed to a fluid dispenser including a housing, a plunger positioned within the housing, and a nozzle. The housing has a fluid inlet, a fluid outlet and a cavity. The plunger is longitudinally positioned within the cavity, and is slidable between a first position and a second position. The first position permits fluid flow from the fluid inlet through the cavity and out from the fluid outlet. The second position prevents fluid flow. The plunger includes first and second ends, a substantially uniformly concave section, a velocity reducing section, a sealing section, and a constant volume section.

In operation, the plunger reduces foaming in carbonated beverages, such as beer, and facilitates pressurization of the fluid delivery system. More specifically, the substantially uniformly concave section is located adjacent the fluid inlet to promote a downward swirling action of the fluid flow when the fluid dispenser is opened, which reduces the velocity and turbulence in the fluid. The velocity reducing section is located at the first end of the plunger, proximate to the fluid outlet, to further reduce the velocity of the fluid. The sealing section is located between the substantially uniformly concave section and the velocity reducing section to seal the cavity when the plunger is in the second position. The constant volume section is located between the sealing section and the velocity reducing section to provide a region of constant volume, when the plunger is in the first position, and further reduce the fluid velocity prior to its exiting from the nozzle.

A velocity reducing device is provided in another aspect of the present invention including a first end which is mated with the fluid inlet, and a second end that is mated with a fluid supply line. Turbulence is created within the velocity reducing device to actively reduce the fluid velocity prior to entering the fluid dispenser.

The present invention is also directed to a fluid dispensing system, wherein the fluid dispenser is incorporated into a system including a fluid container, and a fluid supply line. The fluid supply line is coupled to the fluid container at a first end and the fluid dispenser at an opposite end.

BRIEF DESCRIPTION OF THE DRAWINGS

Preferred, non-limiting embodiments of the present invention will be described by way of example with reference to the accompanying drawings, in which.

DETAILED DESCRIPTION

The present invention is directed to a limited action flow control fluid dispenser that permits rapid disassembly, without specialized tools, to facilitate sterilization of components that are subject to bacterial contamination and enzyme growth. Those components that are exposed to fluid are made of materials that are suitable for use in the food service industry, and are capable of being sterilized. The limited action flow control fluid dispenser of the present invention requires minimal force to move from an open position to a closed position. In addition, the present invention requires a minimal range of motion to move from the closed position to a fully open position, even though a greater range of motion is permitted.

A volume of fluid is retained in the dispenser nozzle when the dispenser is in a closed position to prevent bacterial contamination and enzyme growth by minimizing exposure of internal surfaces of the dispenser to the ambient environment. Accordingly, only a small area of the inner surface of dispenser is not exposed to fluid when the dispenser is in the closed position, thereby maintaining the temperature of the dispenser near the temperature of the fluid and minimizing the possibility of bacterial contamination therein. Moreover, when the fluid being dispensed is carbonated, this small area is occupied by carbon dioxide rather than air, which further retards bacterial growth in the dispenser.

When the dispenser is in the open position, fluid flows into the dispenser through a fluid inlet, it then swirls down and around an internal plunger and through a nozzle. Due to the unique shape of the plunger, swirling of the fluid is promoted, the velocity of the fluid through the dispenser is gradually reduced, and turbulence and foaming within the fluid flow is minimized to lessen product waste. The unique shape of the internal plunger also allows substantially higher pressures to be used in the dispensing system with less foaming than conventional faucets produce during operation at conventional system pressures. Moreover, when the dispenser is switched from the closed position to the open position, the unique internal dimensions of the dispenser prevent any contamination that may be present from reaching the fluid supply lines, by restricting back-flow of fluid within the dispenser.

Figure 2:
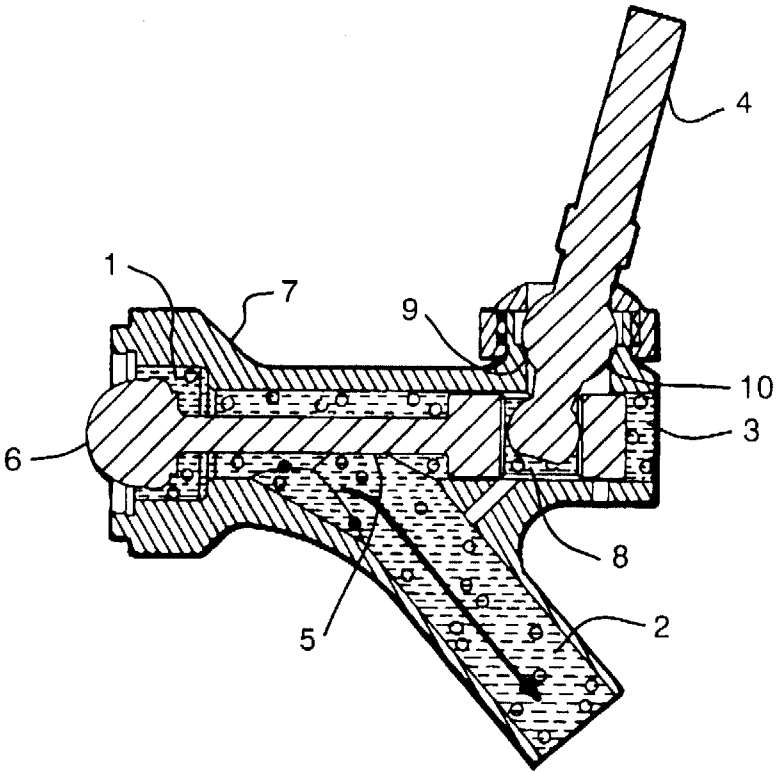
FIG. 2 (PRIOR ART)
FIG. 2 illustrates a faucet in the open position according to the prior art.
Figure 1:
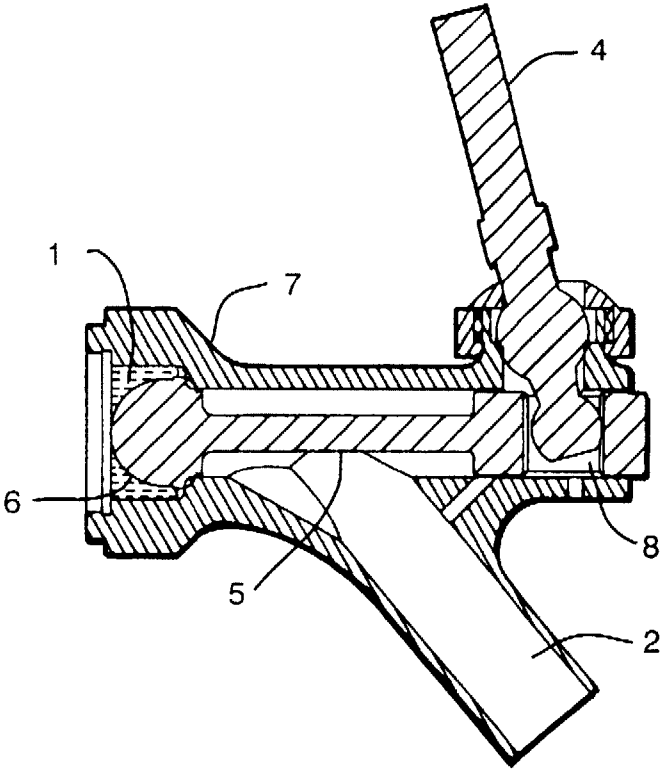
FIG. 1 (PRIOR ART)
FIG. 1 illustrates a faucet in the closed position according to the prior art.
Figure 3:
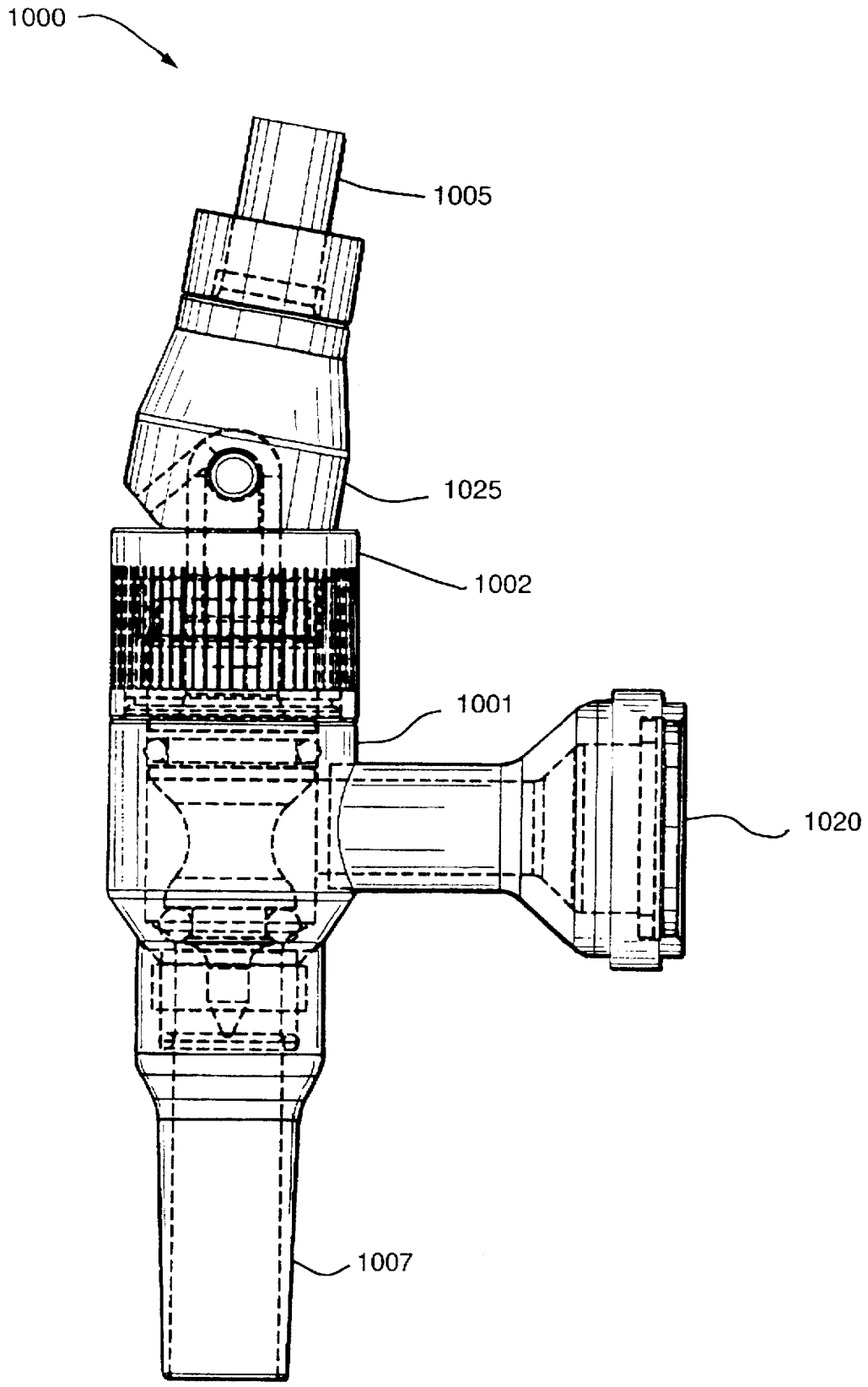
FIG. 3 is a partial, cross-sectional side view of a fluid dispenser according to an embodiment of the present invention.

As shown, FIG. 3 illustrates a partial, cross-sectional side view of a fluid dispenser 1000 according to an embodiment of the present invention. Fluid flows through dispenser 1000 from fluid inlet 1020, into dispenser body 1001, and out through nozzle 1007. An internal plunger (described below) is actuated by lever 1005 to prevent or allow fluid entering fluid inlet 1020 to flow out nozzle 1007. A cover 1025 is placed over the lever 1005 and nut 1006 (not shown) to present a more esthetically pleasing design.

Figure 4:
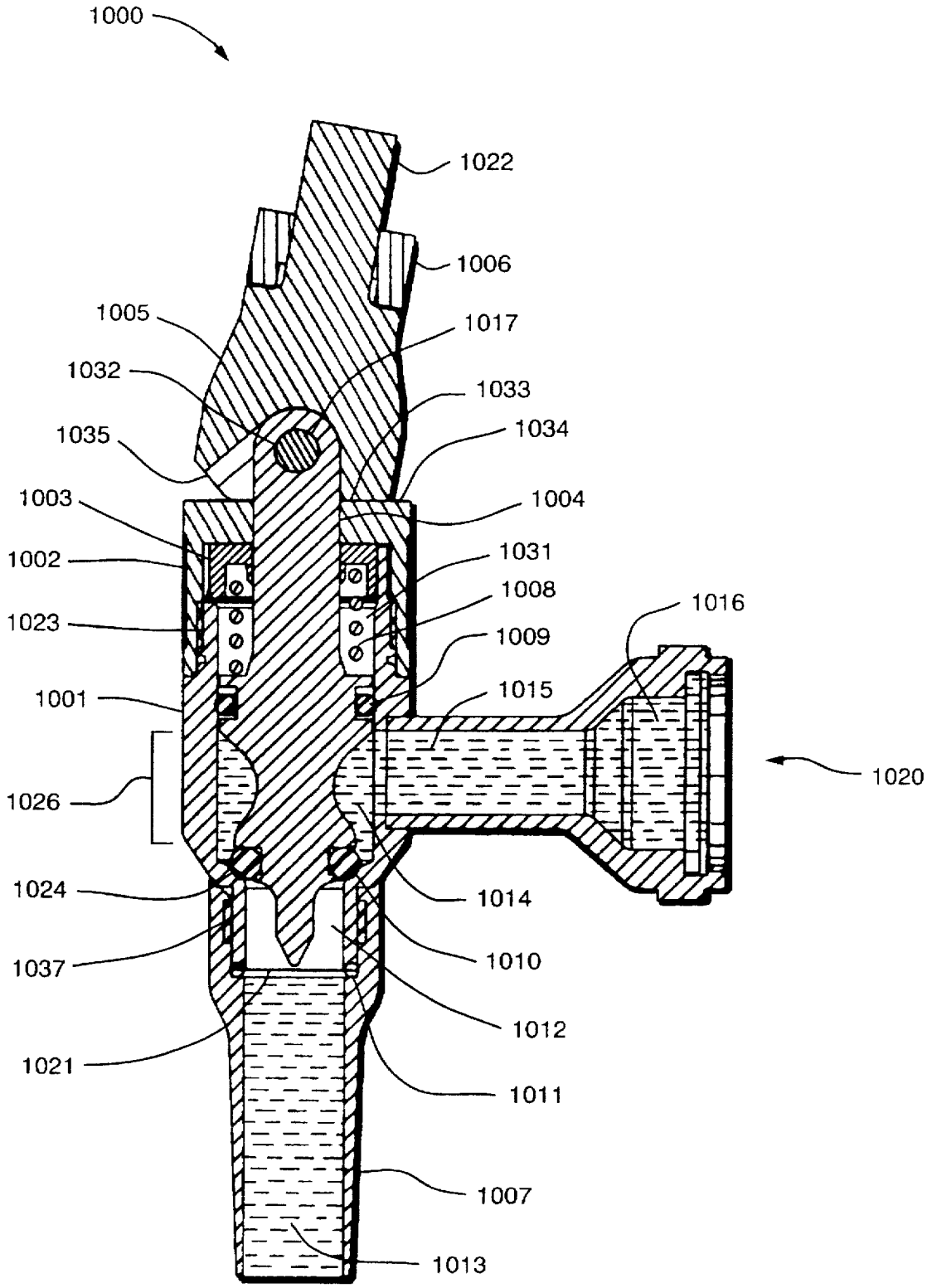
FIG. 4 is a cut-away view of the fluid dispenser of FIG. 3 in the closed position.

A cut-away view of fluid dispenser 1000 in a closed position, according to one embodiment of the present invention, is illustrated in FIG. 4. According to preferred embodiments of the present invention, all surfaces of the fluid dispenser 1000 that are exposed to fluid are formed from non-oxidizing, rigid materials having smooth surfaces to which bacteria do not readily adhere, and which may be sterilized. Of course, other materials could be used without affecting the operational characteristics of the fluid dispenser. Preferably, fluid dispenser 1000 includes a dispenser body 1001 having a fluid inlet 1020, a fluid outlet 1021, and a cavity 1014. The interior portion of fluid inlet 1020 is typically mated to a fluid supply line (not shown). Plunger 1004 is positioned within the cavity 1014 and is slidable between a first position and a second position to open and close the dispenser. The first position, illustrated in FIG. 5, permits fluid flow from fluid inlet 1020 into cavity 1014 and out fluid outlet 1021. The second position, illustrated in FIG. 4, prevents such fluid flow.

Plunger 1004 is formed from smooth, rigid materials that prevent bacterial growth, that do not deform during operation, and are capable of being sterilized. Preferably, the plunger is formed from a material such as a stainless steel, a polymeric material, such as DELRIN™ thermoplastic material (available from E. I. Du Pont de Nemours, & Co., Wilmington, Del.), and the like, such materials being readily available, and capable of being machined to required tolerances. The plunger includes two sealing regions. Seal 1009 provides a dynamic seal between cavity 1014 containing the fluid and an upper portion of the cavity 1031. Seal 1010 provides a seal with contoured region 1024 of the dispenser body, to prevent fluid flow when faucet 1000 is in the closed position. Seals 1009 and 1010 are typically formed from a durable rubber-like material suitable for food service use, such as Buta-n rubber O-rings (FDA approved), which are readily available and can be replaced during maintenance with minimal expense. Plunger 1004 also includes a hole 1032 through which a lever 1005 is pivotally attached via a retaining member 1017.

In a manner similar to conventional faucets, lever 1005 can be rotated approximately 60° while moving from the closed position to the open position. However, in contrast to conventional faucets, the unique shape of lever 1005 reaches the maximum open position within 30° of rotation from the closed position, thereby permitting the use of a large decorative lever/handle (not shown), even in confined service areas. In the closed position, illustrated in FIG. 4, a first bottom portion 1033 of lever 1005 rests against an upper portion 1034 of cap 1002. Top portion 1022 of lever 1005 can be threaded, for example, to receive a nut 1006 that permits a decorative handle (not shown) to be positioned on the lever.

Figure 5:
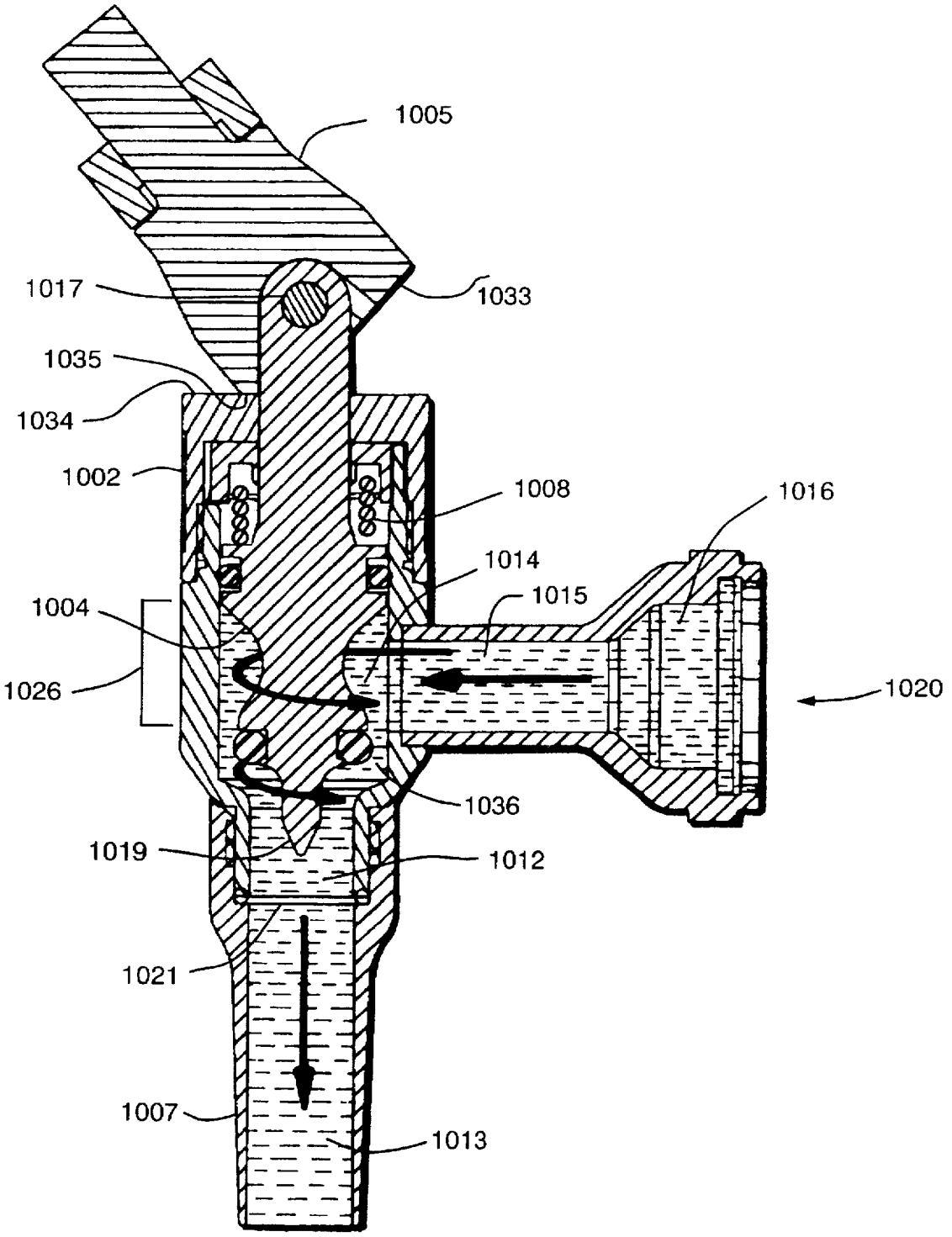
FIG. 5 is a cut-away view of the fluid dispenser of FIG. 3 in the open position.

A biasing member 1008, such as a coil spring, is positioned around the upper portion of the plunger, between the plunger and a retainer 1003, and is not typically exposed to fluid. Biasing member 1008 controls the motion of plunger 1004. As shown in FIGS. 4 and 5, when the biasing member is a spring, it is extended when dispenser 1000 is closed. A cap 1002 is attached to the dispenser body 1001 to keep biasing device 1008 and retainer 1003 in position.

The lower portion of the dispenser body 1001 contains a recessed area for receipt of a seal 1011 that forms an air-tight seal between the faucet body 1001 and nozzle 1007. This air-tight seal permits a volume of fluid 1013, as shown in FIG. 4, to be retained in nozzle 1007 when the dispenser is in the closed position, thereby minimizing exposed dispenser surfaces.

The volume of cavity 1014 that surrounds the uniformly concave region 1026 of plunger 1004 is designed to prevent back-flow of potential contaminants into the plunger or supply line. Preferably, the cavity 1014 volume is approximately twice the volume of region 1012. In the closed position, when the fluid is carbonated, region 1012 is primarily occupied by gas, such as carbon dioxide, primarily supplied from the column of fluid 1013 retained in nozzle 1007 due to contact between seal 1010 and body 1001. When the dispenser 1000 is opened, the gas occupying volume 1012 is pulled into the cavity 1014. However, because volume 1014 is larger than volume 1012, this back-flow is limited to cavity 1014, preventing its expansion into region 1015 or into the beverage supply lines that are connected to fluid inlet 1020 (not shown). Furthermore, when the dispenser is opened, cavity 1014 provides a limited volume in which the carbonated fluid can expand, thus minimizing foaming. Most preferably, the volume of cavity 1014 is greater than the sum of the volumes of regions 1012 and 1013, to ensure that neither the column of fluid retained in region 1013, nor the volume of region 1012 can be drawn further than cavity 1014. As an additional safeguard, the volume of region 1015 is designed to be larger than the volume of cavity 1014, to prevent any possibility of undesired back-flow into the fluid supply line. Moreover, although the volume of region 1016 is dependent on the diameter of the supply line coupling to which the dispenser is attached, the volume of region 1016 is preferably larger than the volume of region 1015 to further prevent any possibility of undesired back-flow into the fluid supply line.

FIG. 5 illustrates a cut-away view of fluid dispenser 1000 in the open position. In the open position, lever 1005 pivots about retaining member 1017 so that second bottom portion 1035 of the lever rests against upper portion 1034 of the cap. Due to the angle and relatively flat surface of the bottom portion 1035, the lever can rest in the open position. Because biasing member 1008 is compressed in the open position, the lever requires a minimal amount of force to return to the closed position. The pivoting action of lever 1005 compresses biasing device 1008 and lifts plunger 1004 to permit fluid flow from fluid inlet 1020, into cavity 1014, through fluid outlet 1021, and through nozzle 1007.

As illustrated in FIG. 5, when the dispenser 1000 is opened, fluid enters cavity 1014 and swirls around and down concave portion 1026 of plunger 1004 and past the tip 1019 of the plunger (as indicated by arrows) into nozzle 1007. It is believed that this swirling action has a two-fold effect on the fluid being dispensed. First, the swirling action reduces the velocity of the fluid flowing through the cavity 1014 and into the nozzle. Second, the swirling action reduces turbulence in the flow of fluid by preventing a convergence of flow at the tip of the plunger. The combination of the plunger's concave portion 1026 and tip 1019, therefore, allow the dispenser to be used at higher pressures, such as between 8 and 18 psi, or higher, without excessive foaming.

Figure 6:
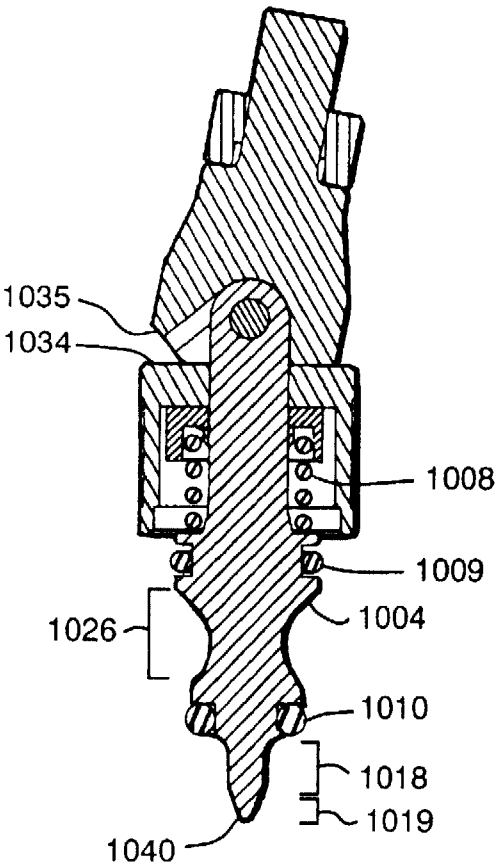
FIG. 6 is a detailed cut-away view of the plunger and lever mechanism according to an embodiment of the present invention.

FIG. 6 illustrates a detailed cut-away view of dispenser plunger 1004. As noted above, plunger 1004 includes a uniformly concave, or hourglass-shaped, region 1026 which functions to prevent contaminating back-flow as well as to reduce foaming of dispensed beverages such as beer. The volume occupied by the uniformly concave region permits the volume of cavity 1014 in the closed position to be larger than the volume of region 1012 (FIGS. 4 and 5) that is immediately below seal 1010. As noted above, this larger volume of the cavity 1014 prevents bacterial contamination, if present, from being pulled back into regions of the fluid dispenser that are more proximate to the fluid supply line. The volume of the cavity 1014 also limits the amount of expansion of the fluid when the dispenser is brought from the closed position, minimizing foaming in the cavity 1014. In addition, the uniformly concave region 1026 promotes a downward swirling action in the flow of fluid when the fluid dispenser is opened. This swirling action (as shown in FIG. 5) reduces the velocity of the fluid flow, and continues as the fluid passes the lower regions of the plunger 1018, 1019, and 1040. Because the swirling action of the fluid continues around tip 1019 and plunger end 1040, turbulence in the flow caused by convergence is reduced, thereby reducing foaming at fluid outlet 1021 and in nozzle 1007 (FIG. 5). Accordingly, the fluid dispenser may be used at substantially higher pressures than conventional fluid dispensers. For example, a beer dispenser according to an embodiment of the present invention can be used at over 18 psi with minimal foaming, whereas, conventional beer dispensers create excessive foaming at pressures over 8–10 psi.

As noted, in addition to the uniformly concave region 1026 of the plunger 1004, the plunger 1004 also includes a constant volume portion 1018, a conical tip 1019, and plunger end 1040. When the fluid dispenser is opened, the alignment of the constant volume portion 1018 with interior portion 1036 of cavity 1014 (FIG. 5) creates a region where the volume is constant. This constant volume portion 1018 of the plunger allows the pressure of the fluid to stabilize prior to exiting the fluid outlet 1021, and this permits operation over a wider range of pressures. The constant volume portion 1018 of the plunger can be any length provided it can be retained within region 1012 of the dispenser. It is noted that a longer portion 1018 allows for a greater pressure to be used in the dispensing system. The plunger 1004 also includes a conical tip 1019, and plunger end 1040 that present a successively larger volume to the dispensed fluid to further slow its velocity prior to exiting the nozzle. As shown, tip 1019 includes plunger end 1040, which is formed at a greater angle than the rest of tip 1019 to further reduce convergence in the flow of fluid and to further reduce the velocity of the fluid exiting fluid outlet 1021.

Figure 7:
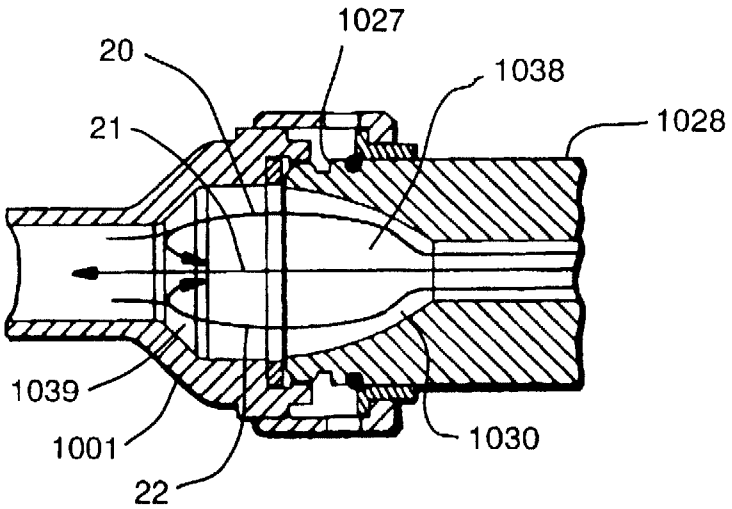
FIG. 7 illustrates a fluid velocity reducing device that can be coupled to a fluid dispenser.

In another aspect of the present invention, a velocity reducing device 1029, as illustrated in FIG. 7, can be coupled to the fluid dispenser 1000. The velocity reducing device includes a first end 1027, which is typically mated with the fluid inlet portion 1020 of the fluid dispenser. A second end 1028 is typically mated with the fluid supply line (not shown). When the velocity reducing device is coupled to the fluid dispenser 1000, and the dispenser is in the open position, the flow of fluid into the fluid inlet portion 1020 is represented by fluid flow lines 20, 21, and 22. Fluid flow lines 20, 21, and 22 enter cavity 1038, and as they pass region 1030, fluid flow lines 20 and 22 expand as shown. Fluid flow lines 20, 21, and 22 continue through cavity 1038, and when they reach region 1039, fluid flow lines 20 and 22 curve toward fluid flow line 21, as shown, and turbulence is created. This turbulence acts as a brake upon the flow of fluid represented by fluid flow line 21, and reduces the velocity of the fluid prior to entering region 1015. Accordingly, the velocity reducing device permits greater pressures to be used to propel the fluid, without affecting the performance of the dispenser 1000.

EXAMPLE 1

One suitable construction of limited action flow control fluid dispenser having a shape and design substantially in accordance with the present invention is provided by the following combination of elements, as illustrated in FIG. 4. The fluid dispenser 1000 includes a fluid dispenser body 1001 that is made from 316 Stainless Steel to provide a smooth surface to which bacteria do not readily adhere. The body includes a cavity 1014 that has an internal diameter of about 0.688 inch. An outlet 1021 from the cavity has an internal diameter of about 0.425 inch. The fluid inlet to the cavity has an internal diameter of about 0.841 inch. Region 1015 has an internal diameter of 0.375 inch, and is about 0.712 inch in length, and the interior diameter of region 1016, to be connected to a fluid supply line, is about 0.680 inch. Contoured region 1024 forms an angle of about 65° with the interior walls of cavity 1014 and fluid outlet 1021, and the overall fluid dispenser body 1001 is about 1.875 inches long. The fluid dispenser body also includes a threaded upper portion 1023 that mates with cap 1002 and a threaded lower portion 1037, that mates with nozzle 1007.

Nozzle 1007 is made from DELRIN™ thermoplastic material, available from E. I. Du Pont de Nemours and Co., Wilmington, Del., and is threaded to mate with threaded lower portion 1037 of the dispenser body, providing an air-tight seal with the dispenser body. Nozzle 1007 is about 1.750 inches long; it has an internal diameter of about 0.435 inch at the dispensing end, and it has an internal diameter of about 0.550 inch at the threaded mating end. Nozzle 1007 includes radial ridges of about 0.25 inch in length, spaced about 30° apart, that protrude about 0.80 inch from the surface at the threaded mating end. These ridges facilitate the attachment and removal of the nozzle to the dispenser body without specialized tools.

Plunger 1004, is made from 316 Stainless Steel to provide a smooth, rigid surface that will not deform during operation, even at substantial system pressures. Plunger 1004 is about 2.255 inches in length from plunger end 1040 to the center point of hole 1032. Constant volume portion 1018 is approximately 0.165 inch in length, and conical tip 1019 is about 0.117 inch in length and tapers to an angle of about 25° from constant volume portion 1018. Plunger end 1040 is about 0.014 inch in length, and tapers to an angle of about 61.7° from constant volume portion 1018. The uniformly concave region 1026 is about 1.009 inches in length, and is formed from an arc having a radius of about 0.210 inch. Plunger 1004 includes two sealing regions for receipt of seals 1009 and 1010, both made from Buta-n-rubber O-rings. Biasing device 1008 is a coil spring made from 302 Stainless Steel.

Retainer 1003 is made from 304 Stainless Steel, and cap 1002 is made from 416 Stainless Steel. Cap 1002 has a knurled exterior surface to facilitate attachment and removal, and is internally threaded to mate with threaded upper portion 1023 of the dispenser body.

Lever 1005 is made from 304 Stainless Steel and top portion 1022 is threaded to receive nut 1006 that is also made from 304 Stainless Steel. The diameter of threaded top portion 1022 readily accepts decorative handles (not shown) that are commonly used in the beverage service industry, and nut 1006 permits the handle to be positioned so that it may be viewed from any chosen position. First bottom portion 1033 of lever 1005 forms an angle of about 132° relative to second bottom portion 1035, and is approximately two-thirds as long as the second bottom portion. Accordingly, first bottom portion 1033 rests against upper portion 1034 of cap 1002 at an angle of about 10° from the vertical axis when closed, and second bottom portion 1035 rests against upper portion 1034 of the cap at an angle of about 48° from the vertical axis when open.

EXAMPLE 2

To determine the effectiveness of the limited action flow control fluid dispenser of the present invention, the fluid dispenser described in EXAMPLE 1 was evaluated and compared to a dispensing tap substantially similar to that disclosed by Hyde, in U.S. Pat. No. 4,720,076 (assigned to Alumasc Ltd.). Each dispenser was attached to a beer supply line secured to a separate keg of beer (BASS® Ale, available from Bass Brewers, Ltd., Burton-On-Trent, England; having approximately 2.2%–2.4% $CO_2$ by volume). The temperature of the beer was 41° F., and each dispenser was tested using the same keg and the same supply line at varying pressures (8, 10, 12, 14, and 18 psi). It is noted that 14 psi is the ideal storage pressure of beer to prevent changes in natural carbonation levels. Each dispenser was used under the same conditions to pour several 16 ounce glasses of beer, and the fluid velocity, foam percentage, and foam character were evaluated. The fluid velocity is based upon the ability to pour beer into the glass without high foam generation due to turbulence in the glass. The foam percentage is measured at the top portion of the filled glass. The foam character is a visual determination of the type of foam created. The experimental results are listed below in Table 1. Ideally, each 16 ounce glass of beer should have approximately 5%, or about ½ inch, of foam at the top of the glass when the glass is filled.

TABLE 1

| DISPENSER TYPE | SYSTEM PRESSURE | FLUID VELOCITY | FOAM PER-CENTAGE | FOAM CHARACTER |
|---|---|---|---|---|
| Invention | 8 psi | Slow | 5% | Dense 3○ |
| Alumasc | 8 psi | Adequate | 10–20% | Dense 2* |
| Invention | 10 psi | Slow | 5% | Dense 3 |
| Alumasc | 10 psi | Fast | 40% | Dense 1+ |
| Invention | 12 psi | Slow | 5% | Dense 3 |
| Alumasc | 12 psi | Too Fast | 70% | Dense 1 |
| Invention | 14 psi | Slow | 5% | Dense 3 |
| Alumasc | 14 psi | Too Fast | 80% | Dense 1 |
| Invention | 18 psi | Adequate | 5% | Dense 3 |
| Alumasc | 18 psi | — | — | — |

○Dense 3 Foam - Low intensity foam (ideal fluid transfer of carbonated beverage to glass). High carbonation level within the fluid. Low levels of foam in fluid flow stream.

*Dense 2 Foam - Intermediate density foam caused by turbulence in the glass. Small amount of natural carbonation in the fluid portion of the beer (soon to be flat beer). Low levels of foam in fluid flow stream.

+Dense 1 Foam - High density foam caused by turbulence from faucet. Little to no natural carbonation in fluid portion of the beer (flat beer). Significant amount of foam in fluid flow stream.

As indicated in Table 1, the present invention, as described in EXAMPLE 1, was compared to a commercially available dispensing tap from Alumasc Ltd. (assignee of U.S. Pat. No. 4,720,076). As the test data illustrates, the Alumasc dispensing tap became unsuitable for use with system pressures above 10 psi, as over one-half of the glass was occupied by high density foam. Furthermore, when the foam eventually subsided, the beer remaining in the glass was essentially flat with little to no natural carbonation remaining in solution. In contrast, the present invention dispensed glasses of beer with minimal amounts of low density foam (about 5%) over a wide range of system pressures, of from 8 psi to 18 psi. In addition, the beer that was dispensed using the present invention retained its natural carbonation in the glass. As noted, the preferred dispensing system pressure is approximately 14 psi, as this pressure prevents change in the $CO_2$ content of the beer. For example, over a period of time, most beers will go flat when the system pressure is under 14 psi, and most beers will become over-carbonated when the system pressure is above 14 psi. The Alumasc dispensing tap, therefore, is not suitable for use with the preferred dispensing system pressure.

Furthermore, as noted, the data reported in Table 1 was collected using BASS® Ale, which is considered to be lower in carbonation than most beers. Therefore, higher, and more dense, amounts of foam can be expected to be generated with other, more highly carbonated beers with the Alumasc dispenser. This increase in the amount of foam is expected due to the turbulence in the flow of beer within the Alumasc dispenser, wherein the dispenser actually strips $CO_2$ from the beer as it is being dispensed, thereby generating significant amounts of foam in the fluid being dispensed. In addition, because of the high velocity of the fluid/foam emanating from the dispenser, additional foaming is created in the glass due to the turbulence that results when this flow hits the glass. When an excessive velocity is used, and the foam finally subsides, the fluid that remains will have lost most of its natural carbonation and will very quickly go flat.

Having thus described at least one illustrative embodiment of the invention, various alterations, modifications, and improvements will readily occur to those skilled in the art. Such alterations, modifications, and improvements are intended to be within the spirit and scope of the invention. For example, a fluid dispensing system according to the aforementioned embodiments can be used with carbonated soft drinks as well as beer. Furthermore, the fluids may have gases other than carbon dioxide dissolved in solution, and need not have any gases dissolved in solution. Accordingly, the foregoing description is by way of example only and is not intended as limiting. The invention is limited only as defined in the following claims and the equivalents thereto.

What is claimed is:

1. A fluid dispenser comprising:

a housing having a fluid inlet, a fluid outlet, and a cavity, said fluid inlet opening into said cavity, and said cavity opening coaxially into said fluid outlet;

a plunger longitudinally positioned in said cavity, said plunger being slidable between a first position and a second position, said first position permitting fluid to flow from said fluid inlet through said cavity and out of said fluid outlet, and said second position preventing fluid flow, said plunger having a first end and a second end, a substantially uniformly concave section, a velocity reducing section, a sealing section, and a constant volume section positioned between said first and second ends, said substantially uniformly concave section being located adjacent said fluid inlet, said velocity reducing section being located at said first end of said plunger proximate to said fluid outlet, said sealing section being located between said substantially uniformly concave section and said velocity reducing section, and said constant volume section being located between said sealing section and said velocity reducing section; and a nozzle attached to said fluid outlet.

2. The fluid dispenser of claim 1, further comprising:

an actuation mechanism pivotally connected to said second end of said plunger, such that said plunger is slidable between said second position and said first position as said mechanism is rotated at least 30°.

3. A fluid dispensing system comprising:

a fluid container;

a fluid supply line coupled to the fluid container; and a fluid dispenser, coupled to the fluid supply line, the fluid dispenser including a housing having a fluid inlet, a fluid outlet, and a cavity, the fluid inlet coupled to the fluid supply line and opening into the cavity, the cavity opening coaxially into the fluid outlet, wherein the fluid dispenser includes a plunger longitudinally positioned in the cavity, the plunger being slidable between a first position and a second position, the first position permitting fluid to flow from the fluid inlet through the cavity and out the fluid outlet, and the second position preventing fluid flow, the plunger having a first end and a second end, a substantially uniformly concave section, a velocity reducing section, a sealing section, and a constant volume section positioned between the first and second ends;

the substantially uniformly concave section being located adjacent the fluid inlet, the velocity reducing section being located at the first end of the plunger proximate to the fluid outlet, the sealing section being located between the substantially uniformly concave section and the velocity reducing section, and the constant volume section being located between the sealing section and the velocity reducing section; and a nozzle attached to the fluid outlet.

4. A fluid dispenser comprising:

a housing having a fluid inlet, a fluid outlet, and a cavity, the fluid inlet opening into the cavity and the cavity opening coaxially into the fluid outlet;

a plunger formed from a rigid material and longitudinally positioned in the cavity, the plunger being slidable between a first position and a second position, the first position permitting fluid to flow from the fluid inlet through the cavity and out the fluid outlet, and the second position preventing fluid flow, wherein the plunger has a first end and a second end, a substantially uniformly concave section, and a constant volume section positioned between the first and second ends, the substantially uniformly concave section being located adjacent the fluid inlet, and the constant volume section being located downstream from the concave section and the fluid outlet;

a sealing section for sealing the cavity, located between the substantially uniformly concave section and the constant volume section; and a nozzle attached to the fluid outlet.

5. The fluid dispenser of claim 4, further comprising:

a velocity reducing section, located at the first end of the plunger proximate the fluid outlet, for reducing the velocity of fluid flowing from the fluid outlet.

6. The fluid dispenser of claim 4, wherein the cavity volume is greater than the void space volume and the volume of fluid retained in the nozzle when the plunger is in the second position.

7. The fluid dispenser of claim 4, wherein the cavity volume is approximately twice the void space volume.

8. The fluid dispenser of claim 4, wherein the plunger includes a second sealing section, located between the substantially uniformly concave section and the plunger second end for sealing the cavity.

9. The fluid dispenser of claim 4, further comprising:

an actuation mechanism pivotally connected to said second end of said plunger, such that said plunger is slidable between said second position and said first position as said mechanism is rotated at least 30°.

10. The fluid dispenser of claim 4, wherein the plunger is formed from a rigid material that can be sterilized.

11. The fluid dispenser of claim 10, wherein the fluid dispenser housing is formed from a rigid material that can be sterilized.

12. The fluid dispenser of claim 4, further comprising:

a velocity reducing device having a first end, a second end, and a cavity positioned between the first and second ends;

the first end of the velocity reducing device being coupled to the fluid inlet of the fluid dispenser and having a first diameter;

the second end of the velocity reducing device being coupled to a fluid supply line and having a second diameter; and the cavity of the velocity reducing device having a diameter larger than the first and second diameters for reducing the velocity of the fluid entering the fluid inlet of the fluid dispenser.

* * * * *